US011150042B2

(12) United States Patent
Hefer et al.

(10) Patent No.: US 11,150,042 B2
(45) **Date of Patent: *Oct. 19, 2021**

(54) RIFLE MAGAZINE LOADER

(71) Applicant: Vista Outdoor Operations LLC, Anoka, MN (US)

(72) Inventors: Brandon Thomas Hefer, St. Louis, MO (US); Brandon Karl Trostrud, St. Louis, MO (US)

(73) Assignee: Vista Outdoor Operations LLC, Anoka, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/010,235

(22) Filed: Sep. 2, 2020

(65) Prior Publication Data

US 2020/0400396 A1 Dec. 24, 2020

Related U.S. Application Data

(63) Continuation of application No. 16/244,180, filed on Jan. 10, 2019, now Pat. No. 10,767,946, which is a continuation of application No. 15/709,043, filed on Sep. 19, 2017, now Pat. No. 10,215,516.

(60) Provisional application No. 62/396,745, filed on Sep. 19, 2016.

(51) Int. Cl.
*F41A 9/83* (2006.01)
*F42B 39/26* (2006.01)

(52) U.S. Cl.
CPC ..... *F41A 9/83* (2013.01); *F42B 39/26* (2013.01)

(58) Field of Classification Search
CPC ..... F41A 9/83; F42B 39/26
See application file for complete search history.

(56) References Cited

U.S. PATENT DOCUMENTS

| | | | |
|---|---|---|---|
| 2,345,593 | A | 4/1944 | Garand |
| 2,887,811 | A | 5/1959 | Johnson, Jr. |
| 4,570,371 | A | 2/1986 | Mears |
| 4,614,052 | A | 9/1986 | Brown et al. |
| 4,688,344 | A | 8/1987 | Kim |
| 4,689,909 | A | 9/1987 | Howard |
| 4,827,651 | A | 5/1989 | Conkey |

(Continued)

OTHER PUBLICATIONS

Supplementary European Search Report cited in corresponding European Application No. 1785179.0 dated Jun. 9, 2020.

(Continued)

*Primary Examiner* — Michelle Clement
(74) *Attorney, Agent, or Firm* — Walter M. Egbert, III; Gerard M. Donovan; Reed Smith LLP

(57) ABSTRACT

A magazine loader comprises a body for receiving an upper portion of the magazine and a cap slidingly engaged with the body for loading cartridges in to the magazine received by the body. The body comprises a plurality of wall portions defining a body cavity configured to receive an upper portion of a magazine. The plurality of cap wall portions may comprise a starboard cap wall portion and an opposing port cap wall portion. An upper portion of the body is slidingly received in the interior volume defined by the cap so that the body and the cap slide relative to one another along a sliding axis. The sliding axis may extend in the upward and downward directions and the cap may translate between an upper position and a lower position along the sliding axis.

17 Claims, 12 Drawing Sheets

(56) References Cited

U.S. PATENT DOCUMENTS

| | | | | |
|---|---|---|---|---|
| 4,829,693 | A | 5/1989 | Holmes | |
| 4,993,180 | A | 2/1991 | Upchurch | |
| 5,249,386 | A | 10/1993 | Switzer | |
| 5,402,594 | A | 4/1995 | Switzer | |
| 6,754,987 | B1 | 6/2004 | Cheng et al. | |
| 6,810,616 | B2 | 11/2004 | Tal et al. | |
| 6,817,134 | B2 | 11/2004 | Newman | |
| 7,383,657 | B2 | 6/2008 | Pikielny | |
| 7,805,874 | B2 | 10/2010 | Tal et al. | |
| 8,356,441 | B2 | 1/2013 | Meinel | |
| 9,212,859 | B1 | 12/2015 | Tal et al. | |
| 9,772,152 | B1 | 9/2017 | Niccum | |
| 10,215,516 | B2 * | 2/2019 | Hefer | F42B 39/26 |
| 10,222,155 | B2 * | 3/2019 | Hefer | F41A 9/84 |
| 10,767,946 | B2 * | 9/2020 | Hefer | F41A 9/83 |
| 10,767,948 | B2 * | 9/2020 | Hefer | F42B 39/26 |
| 2004/0159035 | A1 | 8/2004 | Newman | |
| 2009/0044440 | A1 | 2/2009 | Tal et al. | |
| 2013/0232843 | A1 | 9/2013 | Bajuelo | |
| 2014/0298704 | A1 | 10/2014 | Niccum | |
| 2015/0377573 | A1 | 12/2015 | Niccum | |
| 2017/0051992 | A1 | 2/2017 | Cottrell et al. | |

OTHER PUBLICATIONS

European Search Opinion cited in corresponding European Application No. 1785179.0 dated Jun. 9, 2020.

* cited by examiner

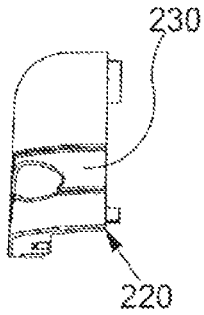
FIG. 7D
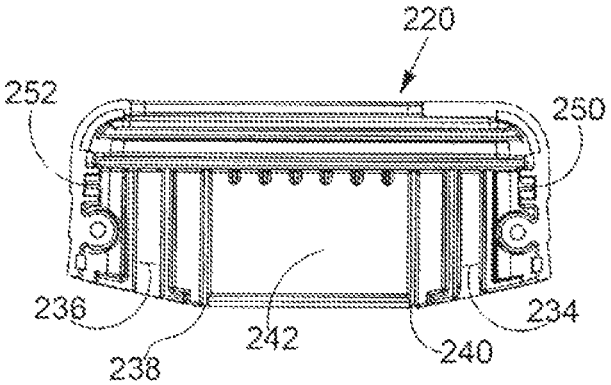
FIG. 7E
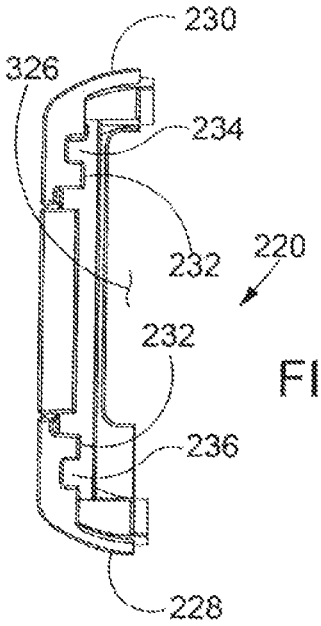
FIG. 7F
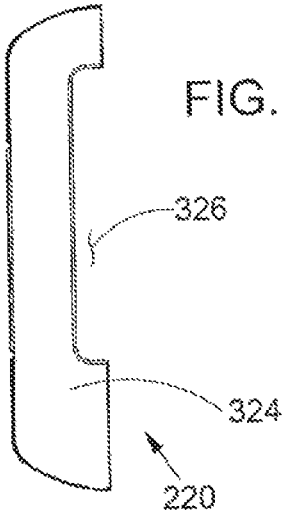
FIG. 8C
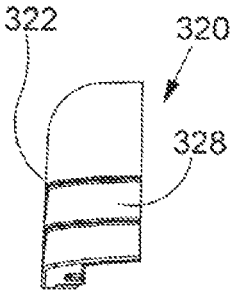
FIG. 8A
FIG. 8B
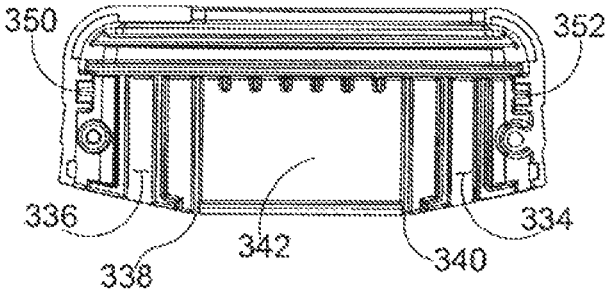

320

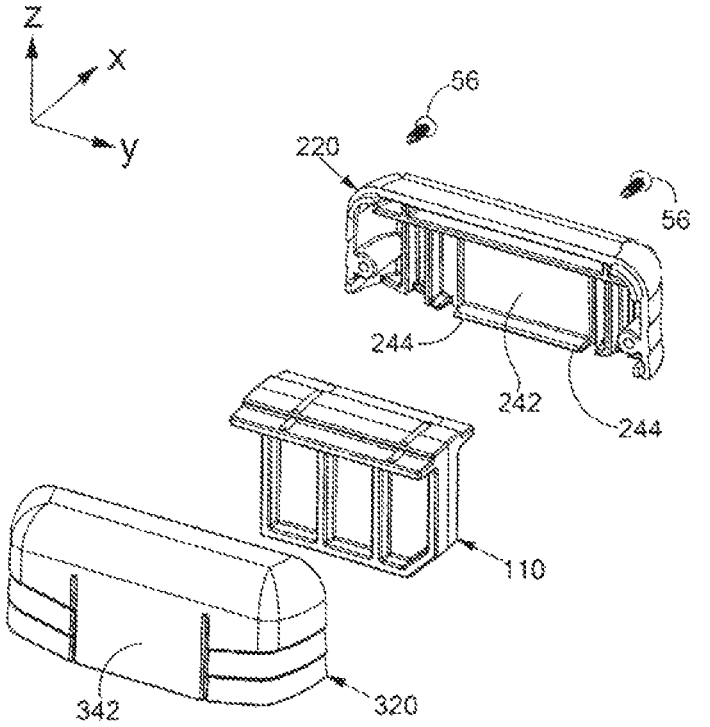
FIG. 15
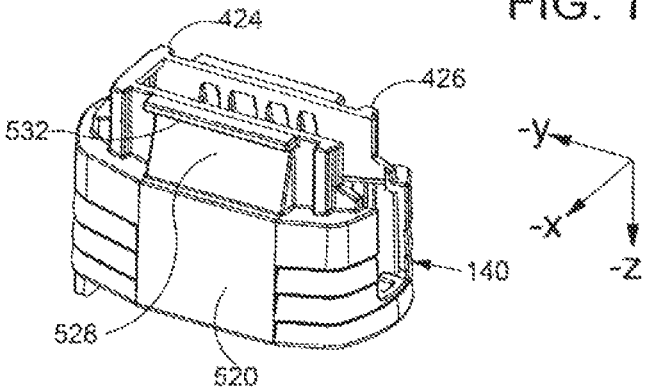

RIFLE MAGAZINE LOADER

CROSS-REFERENCE TO RELATED APPLICATIONS

This application is a continuation of U.S. patent application Ser. No. 16/244,180, filed on Jan. 10, 2019, which is a continuation of U.S. patent application Ser. No. 15/709,043 which was filed on Sep. 19, 2017, and issued on Feb. 26, 2019 as U.S. Pat. No. 10,215,516, which claims the benefit of U.S. Provisional Patent Application No. 62/396,745, filed Sep. 19, 2016, the disclosures of which are incorporated by reference herein.

BACKGROUND OF THE DISCLOSURE

In order to maintain their proficiency with various types of firearms, military personnel, law enforcement officers, and hunters frequently engage in target practice. Target practice is often performed at a shooting range with 300 or more cartridges being fired at each practice session. In the sport of hunting, marksmanship is practiced so that a shot can be carefully placed to ensure a quick, clean and humane kill. For military personnel, good marksmanship may make the difference between victory and defeat in battlefield situations.

Many firearms, including pistols and rifles, are designed to utilize a removable magazine that holds ammunition cartridges. The use of a magazine allows a plurality of cartridges to be easily loaded into the firearm by inserting a single magazine into the firearm. After each cartridge is fired, a manually or automatically operated mechanism moves the bolt of the firearm backward and then forward again. The upper most cartridge in the magazine is pulled off of a stack of cartridges each time the mechanism cycles so that cartridges are fed one-by-one into the firing chamber of the firearm. Each magazine typically has an elongate housing defining a chamber with a spring loaded follower slidably disposed therein. The force of the spring loaded follower urges each cartridge in the magazine toward the upper most position in the where the bolt can push it into the firing chamber. When all of the cartridges have been fired, the empty magazine is removed from the firearm and a new magazine is inserted in its place. The empty magazine may then be refilled with cartridges.

SUMMARY

An example magazine loader comprises a body for receiving an upper portion of the magazine and a cap slidingly engaged with the body for loading cartridges in to the magazine received by the body. The body comprises a plurality of wall portions defining a body cavity with a lower opening proximate a bottom end thereof. The body cavity may be configured to receive an upper portion of a magazine to be loaded with cartridges. The body cavity may extend along a magazine insertion axis extending in upward and downward directions. In some embodiments, the plurality of body wall portions comprise a starboard body wall and an opposing port body wall.

In some embodiments, the starboard body comprises a starboard ramp and the port body wall comprises a port ramp. The cap comprises a plurality of cap wall portions defining an interior volume. The plurality of cap wall portions comprise a starboard cap wall portion and an opposing port cap wall portion. An upper portion of the body is slidingly received in the interior volume defined by the cap so that the body and the cap slide relative to one another along a sliding axis. The sliding axis may extend in the upward and downward directions and the cap may translate between an upper position and a lower position along the sliding axis.

In some embodiments, the starboard cap wall portion defines a first starboard slot and a second starboard slot. Each starboard slot may extend in the upward and downward directions. In some embodiments, the starboard cap wall portion includes a starboard leaf spring portion disposed between the first starboard slot and the second starboard slot. The starboard leaf spring portion may have a fixed end and a free end. In some embodiments, the starboard leaf spring portion comprises a starboard ramp engaging portion proximate the free end thereof and the starboard ramp engaging portion contacts the starboard ramp of the body. In some embodiments, the port cap wall portion defines a first port slot and a second port slot. Each port slot may extend in the upward and downward directions. In some embodiments, the port cap wall portion includes a port leaf spring portion disposed between the first port slot and the second port slot. The port leaf spring portion may have a fixed end and a free end. In some embodiments, the port leaf spring portion comprises a port ramp engaging portion proximate the free end thereof and the port ramp engaging portion contacts the port ramp of the body. In some embodiments, when the cap is urged to translate downward along the sliding axis each ramp applies a reaction force to each ramp engaging portion. The orientation of each ramp relative to the sliding axis may be such that each reaction force has an outwardly directed component that acts to deflect each leaf spring portion in a cantilevered fashion and an upwardly directed component. The upwardly directed components may urge the cap to translate in the upward direction along the sliding axis toward the upper position.

In some embodiments, the magazine loader further includes a latch member adapted and configured to hold the magazine in position relative to the body of the magazine loader. In some embodiments, the starboard body wall defines a first slit and a second slit. The first slit and the second slit may each extend in the upward and downward directions. The starboard body wall may comprise a cantilevered beam of the latch member disposed between the first slit and the second slit. The cantilevered beam may have a fixed end and a free end. In some embodiments, a blocking member is fixed to the cantilevered beam proximate the free end thereof. In some embodiments, the blocking member comprises a projection extending in a portward direction beyond a portward facing surface of the cantilevered beam.

In some embodiments, the magazine loader further includes a latch member adapted and configured to hold the magazine in position relative to the body of the magazine loader. In some embodiments, the rear body wall of the body defines a first slit and a second slit. Each slit may extend in the upward and downward directions. In some embodiments, a rear body wall of the body comprises a cantilevered beam of the latch member disposed between the first slit and the second slit. The cantilevered beam may have a fixed end and a free end. In some embodiments, a blocking member is fixed to the cantilevered beam proximate the free end thereof. In some embodiments, the blocking member comprises a projection extending in a forward direction beyond a forward facing surface of the cantilevered beam.

In some embodiments, the body comprises a starboard flange extending in the upward direction beyond the starboard body wall and a port flange extending in the upward direction beyond the port body wall. In some embodiments, a throat is defined between the starboard flange and the port flange. The throat may be dimensioned and configured to allow sequential passage of a plurality of individual cartridges into the body cavity. The throat may be dimensioned and configured to allow sequential passage of a plurality of individual cartridges into a magazine having an upper portion extending into the body cavity. In some embodiments, the cap comprises a plunger supported by a top panel of the cap. In some embodiments, the plunger extends downward from the top panel into the interior volume defined by the cap.

In some embodiments, the body comprises a first starboard rail and the first starboard rail extending in the upward direction along a first starboard rail axis. In some embodiments, the first starboard rail projects in the starboard direction beyond a starboard facing surface of the starboard flange. In some embodiments, the first starboard rail extends into a first starboard channel defined by the starboard cap wall portion. In some embodiments, the body comprises a second starboard rail and the second starboard rail extending in the upward direction along a second starboard rail axis. In some embodiments, the second starboard rail extends in the upward direction away from the starboard body wall. In some embodiments, the second starboard rail projects in the starboard direction beyond a starboard facing surface of the starboard flange. In some embodiments, the second starboard rail extends into the second starboard channel defined by the starboard cap wall portion. In some embodiments, the body comprises a first port rail and the first port rail extends in the upward direction along a first port rail axis. In some embodiments, the first port rail extends in the upward direction away from the port body wall. In some embodiments, the first port rail projects in the port direction beyond a port facing surface of the port flange. In some embodiments, the first port rail extends into the first port channel defined by the port cap wall portion. In some embodiments, the body comprises a second port rail and the second port rail extends in the upward direction along a second port rail axis. In some embodiments, the second port rail extends in the upward direction away from the port body wall. In some embodiments, the second port rail projects in the port direction beyond a port facing surface of the port flange. In some embodiments, the second port rail extends into the second port channel defined by the port cap wall portion.

In one or more embodiments, a magazine loader for loading cartridges into a magazine may comprise a cap including a starboard shell and a port shell. The shells of the cap cooperating to define an entrance and an interior volume fluidly communicating with the entrance. In one or more embodiments, the entrance faces the downward direction. The cap comprises a starboard shell wall of the starboard shell and a port shell wall of the port shell disposed on opposite sides of the interior volume.

The cap also comprises a top panel extending in a port direction from the starboard shell wall to the port shell wall and extending in a starboard direction from the port shell wall to the starboard shell wall. The top panel comprises a top panel portion of the starboard shell and a top panel part of the port shell. The top panel defines an aperture. The top panel portion of the starboard shell defines a starboard aperture portion, and the top panel part of the port shell defines a port aperture portion.

The cap also comprises a front wall extending in the port direction from the starboard shell wall to the port shell wall and extending in the starboard direction from the port shell wall to the starboard shell wall. In one or more embodiments, the front wall may extend in the upward direction from the entrance to the top panel and extends in the downward direction from the top panel to the entrance. The front wall comprises a front wall portion of the starboard shell and a front wall part of the port shell.

In one or more embodiments, the cap may also comprise a rear wall extending in the port direction from the starboard shell wall to the port shell wall and extending in the starboard direction from the port shell wall to the starboard shell wall. In one or more embodiments, the rear wall may extend in the upward direction from the entrance to the top panel and extending in the downward direction from the top panel to the entrance. The rear wall comprises a rear wall portion of the starboard shell and a rear wall part of the port shell.

The starboard shell wall of the starboard shell extends in the forward direction from the rear wall to the front wall and extends in the rearward direction from the front wall to the rear wall. In one or more embodiments, the starboard shell wall may extend in the upward direction from the entrance to the top panel and extending in the downward direction from the top panel to the entrance. The port shell wall of the port shell extends in the forward direction from the rear wall to the front wall and extends in the rearward direction from the front wall to the rear wall. In one or more embodiments, the port shell wall extends in the upward direction from the entrance to the top panel and extends in the downward direction from the top panel to the entrance.

The starboard shell comprises a plurality of starboard ribs. Each starboard rib protrudes in the port direction beyond a port facing inner surface of the starboard shell wall. The starboard ribs define a first starboard channel and a second starboard channel. The port shell comprises a plurality of port ribs. Each port rib protrudes in the starboard direction beyond a starboard facing inner surface of the port shell wall. The port ribs defining a first port channel and a second port channel.

A body of the magazine loader comprises a starboard body wall and a port body wall disposed on opposite sides of a cavity. In one or more embodiments, the cavity extends in upward and downward directions along a magazine insertion and removal axis. The cavity fluidly communicating with a bottom opening and a top opening defined by the body. In one or more embodiments, the top opening faces the upward direction, and the bottom opening faces the downward direction. In one or more embodiments, the cavity is dimensioned and adapted to receive an upper portion of the magazine. The body comprises a front body wall extending in the port direction from the starboard body wall to the port body wall and extending in the starboard direction from the port body wall to the starboard body wall. In one or more embodiments, the front body wall extends in the upward direction from the bottom opening to the top opening and extends in the downward direction from the top opening to the bottom opening.

The body comprises a rear body wall extending in the port direction from the starboard body wall to the port body wall and extending in the starboard direction from the port body wall to the starboard body wall. In one or more embodiments, the rear body wall extends in the upward direction from the bottom opening to the top opening and extends in the downward direction from the top opening to the bottom opening. The starboard body wall extends in the forward direction from the rear body wall to the front body wall and extends in the rearward direction from the front body wall to the rear body wall. The port body wall extends in the forward direction from the rear body wall to the front body wall and extends in the rearward direction from the front body wall to the rear body wall.

The body comprises a starboard flange extending in the upward direction beyond the starboard body wall. The body also comprises a first starboard rail. The first starboard rail extending in the upward direction away from the starboard body wall. The first starboard rail also projecting in the starboard direction beyond a starboard facing surface of the starboard flange. The first starboard rail extends into the first starboard channel defined by the starboard ribs. In one or more embodiments, the body also comprises a second starboard rail. The second starboard rail extending in the upward direction away from the starboard body wall. The second starboard rail projecting in the starboard direction beyond a starboard facing surface of the starboard flange. The second starboard rail extends into the second starboard channel defined by the starboard ribs.

The body of the magazine loader comprises a first port rail. The first port rail extends in the upward direction away from the port body wall. The first port rail projecting in the port direction beyond a port facing surface of the port flange. The first port rail extends into the first port channel defined by the port ribs. The body also comprises a second port rail. The second port rail extending in the upward direction away from the port body wall. The second port rail also projecting in the port direction beyond a port facing surface of the port flange. The second port rail extends into the second port channel defined by the port ribs.

The body of the magazine loader also comprises a starboard ramp located upward of the starboard body wall. The starboard ramp has a starboard ramp surface extending in a portward, upward direction beyond an upper end of the starboard body wall. The body includes at least one starboard stop fixed to an upper end of the starboard ramp. The at least one starboard stop comprises a downward facing surface. The body also comprises a port ramp located upward of the port body wall. The port ramp has a port ramp surface extending in a starboard, upward direction beyond an upper end of the port body wall. The body includes at least one port stop fixed to an upper end of the port ramp. The port stop comprises a downward facing side.

The starboard shell wall defines a first starboard slot and a second starboard slot, each of the slots extending in the upward and downward directions. The starboard shell wall includes a starboard leaf spring portion disposed between the first starboard slot and the second starboard slot. The starboard leaf spring portion comprises a ramp engaging portion having a ramp engaging surface. The ramp engaging portion comprises a starboard protrusion. The starboard protrusion extends in a port direction beyond a port facing inner surface of the starboard leaf spring portion. The ramp engaging surface of the ramp engaging portion contacts the starboard ramp surface of the starboard ramp. The port shell wall defines a first port slot and a second port slot, each slot extending in the upward and downward directions. The port shell wall includes a port leaf spring part disposed between the first port slot and the second port slot. The port leaf spring part comprises a ramp engaging part having a ramp engaging edge. The ramp engaging part comprises a port protrusion. The port protrusion extends in a starboard direction beyond a starboard facing inner surface of the port leaf spring part. The ramp engaging edge of the ramp engaging part contacts the port ramp surface of the port ramp.

In one or more embodiments, the magazine loader comprises a latch member adapted and configured to hold a magazine in position relative to the body of the magazine loader. In one or more embodiments, a selected one of the body walls defines a first slit and a second slit, each slit extending in the upward and downward directions. The selected one of the body walls also comprises a cantilevered beam disposed between the first slit and the second slit. The cantilevered beam has a fixed end and a free end. A blocking member is fixed to the cantilevered beam proximate to the free end thereof. In one or more embodiments, a portion of the blocking member is positioned, dimensioned, and adapted to be received in a depression defined by the magazine.

In embodiments, a magazine loader for loading cartridges in a rifle magazine, the magazine being an elongate four sided enclosure with an open interior, an upper end, with an open top, a spring loaded platform movably constrained in the open interior for pushing cartridges in the magazine to the open top for feeding into the rifle, the magazine loader comprising a body and a cap slidingly engaged with the body; wherein the body has a pair of opposing forward and rearward wall portions and a pair of lateral wall portions, together defining a body interior and an open bottom conformingly sized to receive the upper end of the rifle magazine, a forward upward slot sized for sequentially receiving a plurality of individual cartridges into the interior of the body, and a pair of upwardly extending slide guides with a forward backward slot opening within the pair of slide guides; and wherein the cap has four side wall portions defining a cap interior and the cap is slidingly attached to the upwardly extending slide guides within the four side wall portions, the cap having a downward projection within the four side wall portions positioned for pushing one of the plurality of individual cartridges inserted into the forward upper slot downward into the magazine when the magazine has been inserted into the open bottom of the body, the cap movable on the body downwardly for the cartridge loading.

In embodiments, such a magazine loader has the cap is biased upwardly with respect to the body whereby when the cap is not being pushed downwardly with respect to the body, the cap is urged to a normal upward position.

In embodiments such a magazine loader of above where the cap is biased upwardly by a pair of upwardly extending slide guides each having a taper upwardly and the cap has resilient slide guide engaging portions that are deflected outwardly by the slide guides as the cap is pushed downwardly with respect to the body.

In embodiments, a magazine loader for loading cartridges in a magazine comprises a body and a cap slidingly engaged with the body; wherein the body has a pair of opposing forward and rearward wall portions and a pair of lateral wall portions, together defining a body interior and an open bottom conformingly sized to receive the upper end of the rifle magazine, a forward upward slot sized for receiving individual cartridges into the interior of the body, and a pair of upwardly extending slide guides with a slot extending forwardly and rearwardly within the pair of slide guides, each of the slide glides having an outwardly facing surface that is tapered in an upwardly direction; and wherein the cap has four side wall portions defining a cap interior and the cap is slidingly attached to the upwardly extending slide guides within the four side wall portions, the cap having a downward projection within the four side wall portions positioned for pushing a cartridge inserted into the forward upper slot downward into the magazine when the magazine is inserted into the open bottom of the body, the cap biased to an upward position by a pair of leaf springs engaged with the pair of slide guides. In embodiments, such a magazine loader as above, wherein the leaf springs have a substantially undeflected position when the cap is in an upward position and the pair of leaf springs are each increasingly deflected outwardly as the cap is pushed downwardly with respect to the body whereby the deflected leaf springs urge the cap toward the upward position. In embodiments, such a magazine loader as described above, further comprising a cartridge ejection member within the cap, the cartridge ejection member having an exposed lever, the cartridge ejection member movable forwardly to force a cartridge in an uppermost position in the magazine out of the magazine and out of the forward upper slot of the body. In embodiments, the cartridge ejection member is slidingly engaged with the cap.

In embodiments, a magazine loader comprising a body for receiving a magazine and a cap slidingly engaged with the body for loading cartridges into the magazine received by the body; wherein the body has a pair of opposing forward and rearward wall portions and a pair of lateral wall portions, together defining a body interior and an open bottom conformingly sized to receive the upper end of the rifle magazine, an upward slot sized for receiving individual cartridges into the interior of the body, wherein the cap is movably attached to the body, the cap having a downwardly extending plunger that is received in the upward slot and that is configured for pushing a cartridge into the open interior of the magazine received by the body, and wherein one of the cap and body having a slide guide tapered in a direction away from said one with respect to a vertical axis of said one and the other of the cap and body having a spring member for engaging the slide guide of said one, whereby the cap and body are urged away from each other by the spring member. In embodiments, such as above, one of the cap and body has two slide guides and the other of the cap and body has two spring members. In embodiments, the spring members are a leaf springs. In embodiments, the leaf springs are each defined by two upright slits in a respective lateral wall portion of said one.

The above summary is not intended to describe each illustrated embodiment or every implementation of the present disclosure.

BRIEF DESCRIPTION OF THE FIGURES

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

FIG. 7D is a rear view of the starboard shell shown in FIG. 7A.

FIG. 7E is a left side view of the starboard shell shown in FIG. 7A.

FIG. 7F is a bottom view of the starboard shell shown in FIG. 7A.

FIG. 8A is a front view of a port shell for a magazine loader in accordance with the detailed description.

FIG. 8B is a right side view of the port shell shown in FIG. 8A.

FIG. 8C is a top view of the port shell shown in FIG. 8A.

FIG. 15 is an exploded perspective view of a magazine loader in accordance with the detailed description.

Figure 1:
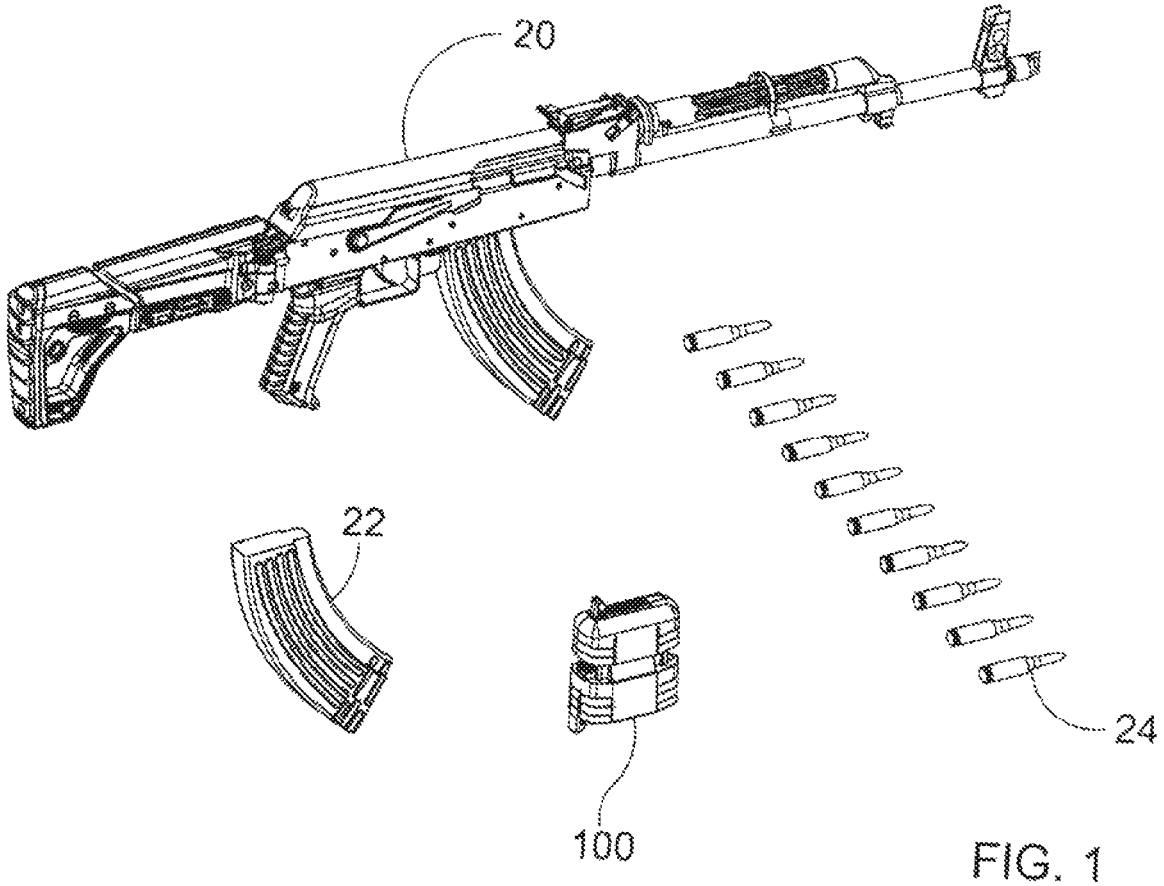
FIG. 1 is a perspective view showing a firearm, a plurality of cartridges, a magazine, and a magazine loader for loading cartridges into a magazine.

While embodiments of the disclosure are amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DETAILED DESCRIPTION

Figure 2:
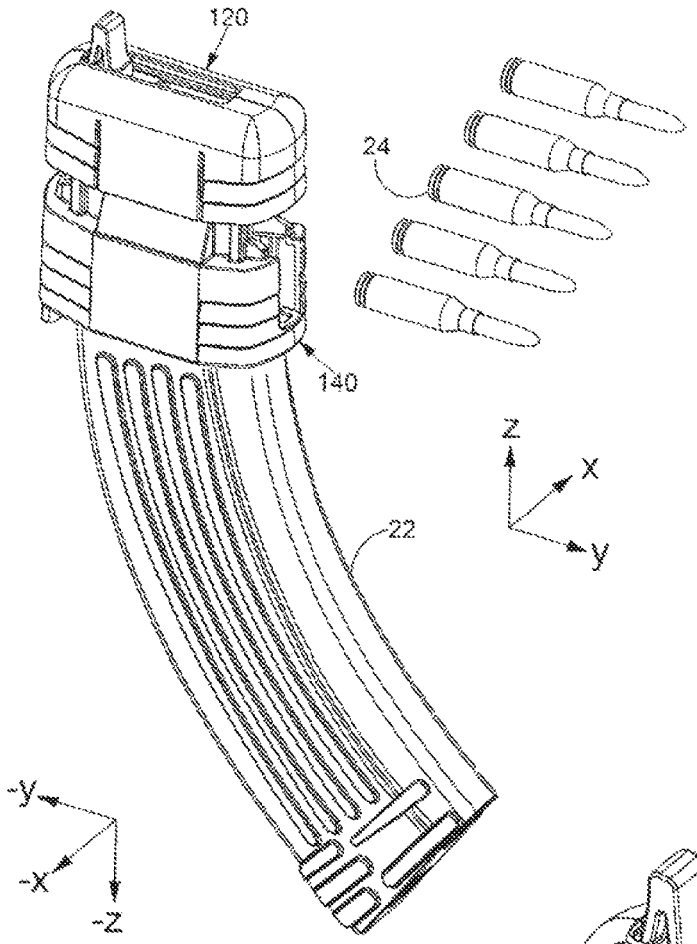
FIG. 2 is a perspective view showing a magazine and a magazine loader in accordance with the detailed description.

FIG. 1 is a perspective view showing a firearm 20, a plurality of cartridges 24, a magazine 22, and a magazine loader 100 for loading cartridges into the magazine 22. FIG. 2 is a perspective view showing a plurality of cartridges 24, a magazine 22, and a magazine loader 100. The magazine loader 100 may be used to load a plurality of cartridges 24 into the magazine.

Figure 3:
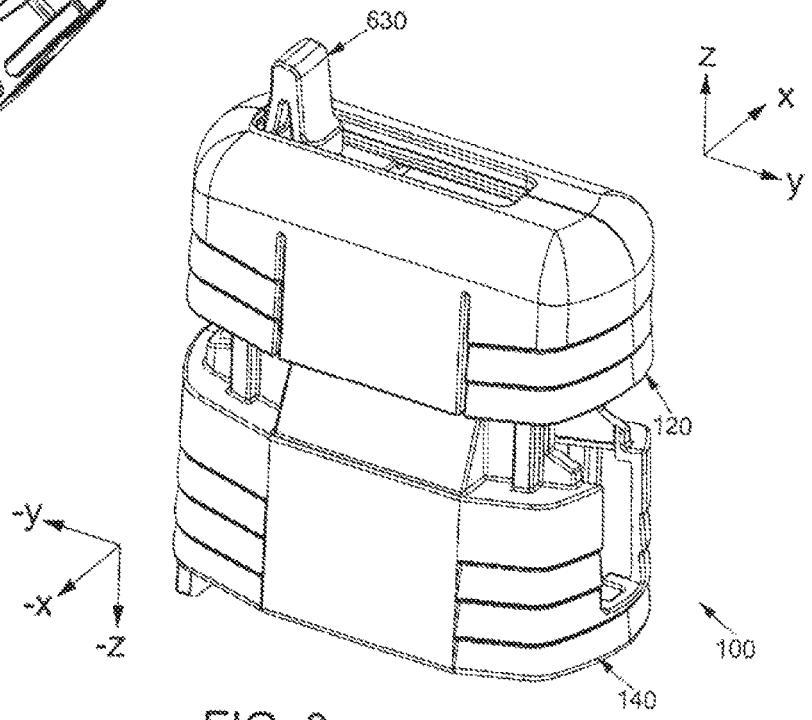
FIG. 3 is perspective views of a magazine loader in accordance with the present invention.
Figure 4:
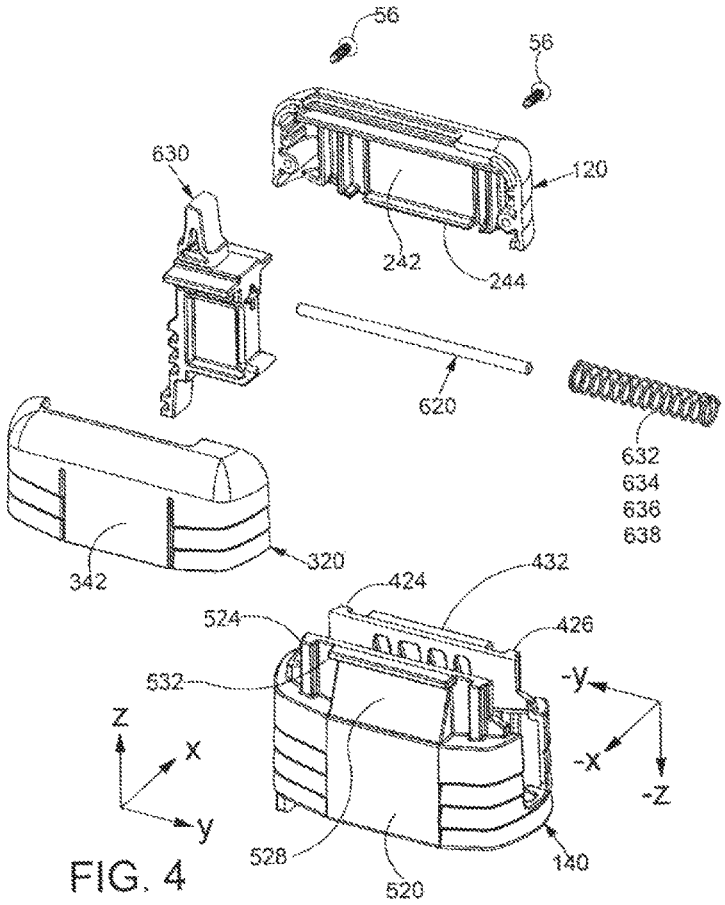
FIG. 4 is an exploded perspective view of a magazine loader in accordance with the detailed description.
Figure 5:
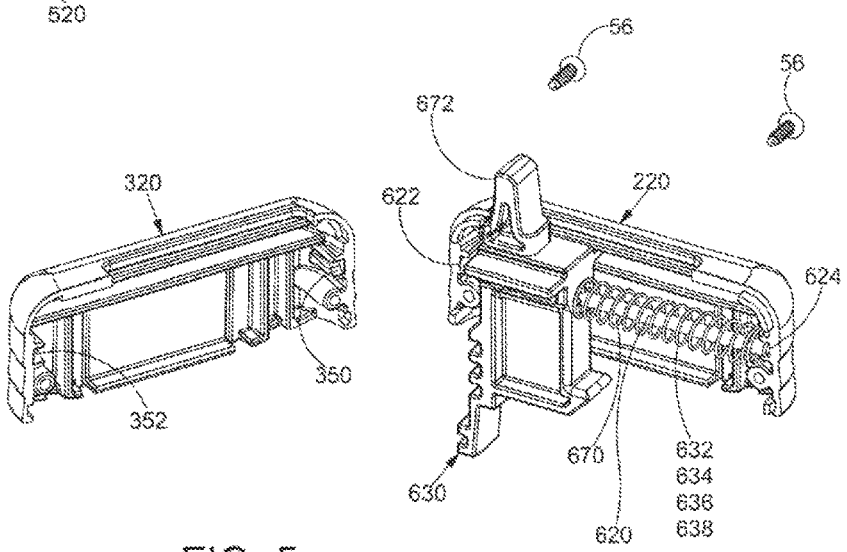
FIG. 5 is a partially exploded perspective view further illustrating selected parts of the magazine loader shown in FIG. 4.
Figure 6:
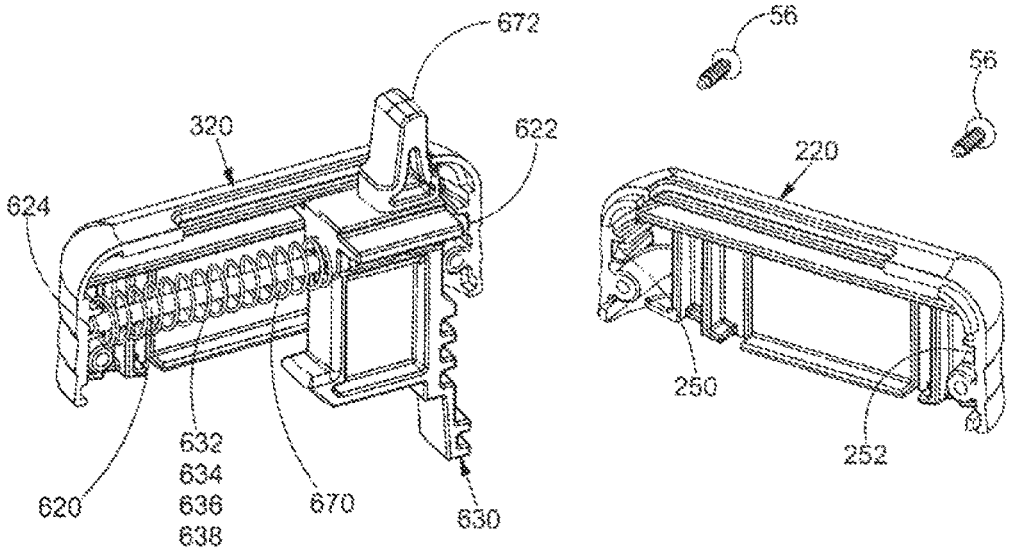
FIG. 6 is a partially exploded perspective view further illustrating selected parts of the magazine loader shown in FIG. 4.

Referring, for example, to FIGS. 3 and 4, an example magazine loader 100 comprises a body 140 for receiving an upper portion of the magazine and a cap 120 slidingly engaged with the body 140 for loading cartridges in to the magazine received by the body 140. The body 140 comprises a plurality of wall portions defining a body cavity 142 with a lower opening proximate a bottom end thereof. The body cavity 142 may be configured to receive an upper portion of a magazine to be loaded with cartridges. The body cavity 142 may extend along a magazine insertion axis 126 extending in upward and downward directions. In some embodiments, the plurality of body wall portions comprise a starboard body wall 420 and an opposing port body wall 520. In some embodiments, the starboard body 140 comprises a starboard ramp 428 and the port body wall 520 comprises a port ramp 528. The cap comprises a plurality of cap wall portions defining an interior volume 124. The plurality of cap wall portions comprise a starboard cap wall portion 222 and an opposing port cap wall portion 322. An upper portion of the body 140 is slidingly received in the interior volume 124 defined by the cap 120 so that the body 140 and the cap 120 slide relative to one another along a sliding axis. The sliding axis may extend in the upward and downward directions and the cap 120 may translate between an upper position and a lower position along the sliding axis.

In some embodiments, the starboard cap wall portion 222 defines a first starboard slot 238 and a second starboard slot 240. Each starboard slot may extend in the upward and downward directions. In some embodiments, the starboard cap wall portion 222 includes a starboard leaf spring portion 242 disposed between the first starboard slot 238 and the second starboard slot 240. The starboard leaf spring portion 242 may have a fixed end and a free end. In some embodiments, the starboard leaf spring portion 242 comprises a starboard ramp engaging portion 244 proximate the free end thereof and the starboard ramp engaging portion 244 contacts the starboard ramp 428 of the body 140. In some embodiments, the port cap wall portion 322 defines a first port slot 338 and a second port slot 340. Each port slot may extend in the upward and downward directions. In some embodiments, the port cap wall portion 322 includes a port leaf spring portion 342 disposed between the first port slot 338 and the second port slot 340. The port leaf spring portion may have a fixed end and a free end. In some embodiments, the port leaf spring portion 342 comprises a port ramp engaging portion 344 proximate the free end thereof and the port ramp engaging portion 344 contacts the port ramp 528 of the body 140. In some embodiments, when the cap 120 is urged to translate downward along the sliding axis each ramp applies a reaction force to each ramp engaging portion. The orientation of each ramp relative to the sliding axis may be such that each reaction force has an outwardly directed component that acts to deflect each leaf spring portion in a cantilevered fashion and an upwardly directed component. The upwardly directed components may urge the cap to translate in the upward direction along the sliding axis toward the upper position.

In some embodiments, the magazine loader further includes a latch member 180 adapted and configured to hold the magazine in position relative to the body 140 of the magazine loader 100. In some embodiments, the starboard body wall 420 defines a first slit 182 and a second slit 184. The first slit 182 and the second slit 184 may each extend in the upward and downward directions. The starboard body wall 420 may comprise a cantilevered beam 186 of the latch member 180 disposed between the first slit 182 and the second slit 184. The cantilevered beam 186 may have a fixed end and a free end. In some embodiments, a blocking member 188 is fixed to the cantilevered beam 186 proximate the free end thereof. In some embodiments, the blocking member 188 comprises a projection 188 extending in a portward direction beyond a portward facing surface of the cantilevered beam 186.

In some embodiments, the magazine loader 100 further includes a latch member 180 adapted and configured to hold the magazine in position relative to the body 140 of the magazine loader 100. In some embodiments, the rear body wall 150 of the body 140 defines a first slit 182 and a second slit 184. Each slit may extend in the upward and downward directions. In some embodiments, a rear body wall 150 of the body 140 comprises a cantilevered beam 186 of the latch member 180 disposed between the first slit 182 and the second slit 184. The cantilevered beam 186 may have a fixed end and a free end. In some embodiments, a blocking member 188 is fixed to the cantilevered beam 186 proximate the free end thereof. In some embodiments, the blocking member 188 comprises a projection 188 extending in a forward direction beyond a forward facing surface of the cantilevered beam 186.

In some embodiments, the body 140 comprises a starboard flange 522 extending in the upward direction beyond the starboard body wall 420 and a port flange 522 extending in the upward direction beyond the port body wall 520. In some embodiments, a throat 144 is defined between the starboard flange 522 and the port flange 522. The throat 144 may be dimensioned and configured to allow sequential passage of a plurality of individual cartridges into the body cavity 142. The throat 144 may be dimensioned and configured to allow sequential passage of a plurality of individual cartridges into a magazine having an upper portion extending into the body cavity 142. In some embodiments, the cap 120 comprises a plunger 110 supported by a top panel 128 of the cap 120. In some embodiments, the plunger 110 extends downward from the top panel 128 into the interior volume 124 defined by the cap 120.

In some embodiments, the body 140 comprises a first starboard rail 424 and the first starboard rail 424 extending in the upward direction along a first starboard rail axis. In some embodiments, the first starboard rail 424 projects in the starboard direction beyond a starboard facing surface of the starboard flange 522. In some embodiments, the first starboard rail 424 extends into a first starboard channel 234 defined by the starboard cap wall portion 222. In some embodiments, the body 140 comprises a second starboard rail 426 and the second starboard rail 426 extending in the upward direction along a second starboard rail axis. In some embodiments, the second starboard rail 426 extends in the upward direction away from the starboard body wall 420. In some embodiments, the second starboard rail 426 projects in the starboard direction beyond a starboard facing surface of the starboard flange 522. In some embodiments, the second starboard rail 426 extends into the second starboard channel 236 defined by the starboard cap wall portion 222. In some embodiments, the body 140 comprises a first port rail 524 and the first port rail 524 extends in the upward direction along a first port rail axis. In some embodiments, the first port rail 524 extends in the upward direction away from the port body wall 520. In some embodiments, the first port rail 524 projects in the port direction beyond a port facing surface of the port flange 522. In some embodiments, the first port rail 524 extends into the first port channel 334 defined by the port cap wall portion 322. In some embodiments, the body 140 comprises a second port rail and the second port rail 526 extends in the upward direction along a second port rail axis. In some embodiments, the second port rail extends in the upward direction away from the port body wall 520. In some embodiments, the second port rail 526 projects in the port direction beyond a port facing surface of the port flange 522. In some embodiments, the second port rail 526 extends into the second port channel 336 defined by the port cap wall portion 322.

Referring, for example, to FIGS. 4-13, a magazine loader 100 for loading cartridges into a magazine in accordance with this detailed description may comprise a cap 120 including a starboard shell and a port shell. The starboard shell 220 and the port shell 320 may be fastened to one another using a plurality of screws 56.

The shells of the cap 120 cooperating to define an entrance 122 and an interior volume 124 fluidly communicating with the entrance 122. In one or more embodiments, the entrance 122 faces the downward direction. The cap 120 comprises a starboard shell wall 222 of the starboard shell 220 and a port shell wall 322 of the port shell 320 disposed on opposite sides of the interior volume 124.

The cap 120 also comprises a top panel 128 extending in a port direction from the starboard shell wall to the port shell wall 322 and extending in a starboard direction from the port shell wall 322 to the starboard shell wall 222. The top panel comprises a top panel portion 224 of the starboard shell 220 and a top panel part 324 of the port shell 320. The top panel 128 defines an aperture 130. The top panel portion 224 of the starboard shell 220 defines a starboard aperture portion 226 and the top panel part 324 of the port shell 320 defines a port aperture portion 326.

The cap 120 also comprises a front wall 132 extending in the port direction from the starboard shell wall 222 to the port shell wall 322 and extending in the starboard direction from the port shell wall 322 to the starboard shell wall 222. In one or more embodiments, the front wall 132 may extend in the upward direction from the entrance 122 to the top panel 128 and extends in the downward direction from the top panel 128 to the entrance 122. The front wall 132 comprises a front wall portion 228 of the starboard shell 220 and a front wall part 328 of the port shell 320.

In one or more embodiments, the cap 120 may also comprise a rear wall 134 extending in the port direction from the starboard shell wall 222 to the port shell wall 322 and extending in the starboard direction from the port shell wall 322 to the starboard shell wall 222. In one or more embodiments, the rear wall 134 may extend in the upward direction from the entrance 122 to the top panel 128 and extending in the downward direction from the top panel 128 to the entrance 122. The rear wall 134 comprises a rear wall portion 230 of the starboard shell 220 and a rear wall part 330 of the port shell.

The starboard shell wall 222 of the starboard shell 220 extends in the forward direction from the rear wall 134 to the front wall 132 and extends in the rearward direction from the front wall 132 to the rear wall 134. In one or more embodiments, the starboard shell wall 222 may extend in the upward direction from the entrance 122 to the top panel 128 and extending in the downward direction from the top panel 128 to the entrance 122. The port shell wall 322 of the port shell 320 extends in the forward direction from the rear wall 134 to the front wall 132 and extends in the rearward direction from the front wall 132 to the rear wall 134. In one or more embodiments, the port shell wall 322 extends in the upward direction from the entrance 122 to the top panel 128 and extends in the downward direction from the top panel 128 to the entrance 122.

The starboard shell 220 comprises a plurality of starboard ribs 232. Each starboard rib 232 protrudes in the port direction beyond a port facing inner surface of the starboard shell wall 222. The starboard ribs 232 define a first starboard channel 234 and a second starboard channel 236. The port shell 320 comprises a plurality of port ribs 332. Each port rib 332 protrudes in the starboard direction beyond a starboard facing inner surface of the port shell wall 322. The port ribs 332 defining a first port channel 334 and a second port channel 336.

A body 140 of the magazine loader comprises a starboard body wall 420 and a port body wall 520 disposed on opposite sides of a cavity 142. In one or more embodiments, the cavity 142 extends in upward and downward directions along a magazine insertion and removal axis 126. The cavity 142 fluidly communicating with a bottom opening 144 and a top opening 146 defined by the body 140. In one or more embodiments, the top opening 146 faces the upward direct and the bottom opening 144 faces the downward direction. In one or more embodiments, the cavity 142 is dimensioned and adapted to receive an upper portion of the magazine. The body 140 comprises a front body wall 148 extending in the port direction from the starboard body wall 420 to the port body wall 520 and extending in the starboard direction from the port body wall 520 to the starboard body wall 420. In one or more embodiments, the front body wall 148 extends in the upward direction from the bottom opening 144 to the top opening 146 and extends in the downward direction from the top opening 146 to the bottom opening 144.

The body 140 comprises a rear body wall 150 extending in the port direction from the starboard body wall 420 to the port body wall 520 and extending in the starboard direction from the port body wall 520 to the starboard body wall 420. In one or more embodiments, the rear body wall 150 extends in the upward direction from the bottom opening 144 to the top opening 146 and extends in the downward direction from the top opening 146 to the bottom opening 144. The starboard body wall 420 extends in the forward direction from the rear body wall 150 to the front body wall 148 and extends in the rearward direction from the front body wall 148 to the rear body wall 150. The port body wall 520 extends in the forward direction from the rear body wall 150 to the front body wall 148 and extends in the rearward direction from the front body wall 148 to the rear body wall 150.

The body 140 comprises a starboard flange 422 extending in the upward direction beyond the starboard body wall 420. The body 140 also comprises a first starboard rail 424. The first starboard rail 424 extending in the upward direction away from the starboard body wall 420. The first starboard rail 424 also projecting in the starboard direction beyond a starboard facing surface of the starboard flange 422. The first starboard rail 424 extends into the first starboard channel 234 defined by the starboard ribs 232. In one or more embodiments, the body 140 also comprises a second starboard rail 426. The second starboard rail 426 extending in the upward direction away from the starboard body wall 420. The second starboard rail 426 projecting in the starboard direction beyond a starboard facing surface of the starboard flange 422. The second starboard rail 426 extends into the second starboard channel 236 defined by the starboard ribs 232.

The body 140 of the magazine loader 100 comprises a first port rail 524. The first port rail 524 extends in the upward direction away from the port body wall 520. The first port rail 524 projecting in the port direction beyond a port facing surface of the port flange 522. The first port rail 524 extends into the first port channel 334 defined by the port ribs 332. The body 140 also comprises a second port rail 526. The second port rail 526 extending in the upward direction away from the port body wall 520. The second port rail 526 also projecting in the port direction beyond a port facing surface of the port flange 522. The second port rail 526 extends into the second port channel 336 defined by the port ribs 332.

The body 140 of the magazine loader also comprises a starboard ramp 428 located upward of the starboard body wall 420. The starboard ramp 428 has a starboard ramp surface 430 extending in a portward, upward direction beyond an upper end of the starboard body wall 420. The body 140 includes at least one starboard stop 432 fixed to an upper end of the starboard ramp 428. The at least one starboard stop 432 comprises a downward facing surface 434. The body 140 also comprises a port ramp 528 located upward of the port body wall 520. The port ramp 528 has a port ramp surface 530 extending in a starboard, upward direction beyond an upper end of the port body wall 520. The body 140 includes at least one port stop 532 fixed to an upper end of the port ramp 528. The port stop 532 comprises a downward facing side 536.

The starboard shell wall 222 defines a first starboard slot 238 and a second starboard slot 240, each of the slots extending in the upward and downward directions. The starboard shell wall 222 includes a starboard leaf spring portion 242 disposed between the first starboard slot 238 and the second starboard slot 240. The starboard leaf spring portion 242 comprising a ramp engaging portion 244 having a ramp engaging surface 248. The ramp engaging portion 244 comprises a starboard protrusion 246. The starboard protrusion 246 extends in a port direction beyond a port facing inner surface of the starboard leaf spring portion 242. The ramp engaging surface 248 of the ramp engaging portion 244 contacts the starboard ramp surface 430 of the starboard ramp 428. The port shell wall 322 defines a first port slot 338 and a second port slot 340, each slot extending in the upward and downward directions. The port shell wall 322 includes a port leaf spring part 342 disposed between the first port slot 338 and the second port slot 340. The port leaf spring part 342 comprises a ramp engaging part 344 having a ramp engaging edge 348. The ramp engaging part 344 comprises a port protrusion 346. The port protrusion 346 extending in a starboard direction beyond a starboard facing inner surface of the port leaf spring part 342. The ramp engaging edge 348 of the ramp engaging part 344 contacts the port ramp surface 530 of the port ramp 528.

In one or more embodiments, the magazine loader 100 comprises a latch member 180 adapted and configured to hold a magazine in position relative to the body of the magazine loader 100. In one or more embodiments, a selected one of the body walls defines a first slit 182 and a second slit 184, each slit extending in the upward and downward directions. The selected one of the body walls also comprises a cantilevered beam 186 disposed between the first slit 182 and the second slit 184. The cantilevered beam 186 has a fixed end and a free end. A blocking member 188 is fixed to the cantilevered beam 186 proximate the free end thereof. In one or more embodiments, a portion of the blocking member 188 is positioned, dimensioned, and adapted to be received in a depression defined by the magazine.

In one or more embodiments, the magazine loader 100 includes a guide pin 620 disposed inside the interior volume 124 defined by the cap 120. The guide pin 620 has a forward end 622 and a rearward end 624 and the guide pin 620 is positioned and oriented to extend in the forward and rearward directions between the forward end and the rearward end 624 thereof. The forward end 622 of the guide pin 620 is disposed between the starboard shell 220 and the port shell 320. In one or more embodiments, the forward end 622 of the guide pin 620 is received in a forward starboard notch 250 defined by the starboard shell 220 and a forward port notch 350 defined by the port shell 320. In one or more embodiments, the rearward end 624 of the guide pin 620 is disposed between the starboard shell 220 and the port shell 320. The rearward end 624 of the guide pin being received in a rearward starboard notch 252 defined by the starboard shell 220 and a rearward port notch 352 defined by the port shell 320.

In one or more embodiments, the magazine loader 100 comprises a plunger 630 slidably supported by the guide pin 620 and a spring 632 disposed about the guide pin 620. The plunger 630 defines a bore 674 and the guide pin 620 extends through the bore 674 so that the plunger 630 is slidable along the guide pin 620. The spring 632 comprises a length of wire 634 forming a plurality of turns 636. The plurality of turns 636 form a coil 638. The coil 638 defines a lumen 670. The plurality of turns 636 are disposed about the guide pin 620 and the guide pin 620 extends through the lumen 670 defined by the spring 632. The spring 632 is seating against the plunger 630 and acts to bias the plunger 630 for movement in the forward direction. The plunger 630 includes a knob portion 672. In one or more embodiments, the knob portion 672 extends in the upward direction through the aperture 130 defined by the cap 120. A user of the magazine loader 100 may selectively move the plunger 630 in the rearward direction against a biasing force of the spring 632 by applying appropriate force to the knob portion 672.

Referring, for example, to FIGS. 2, 3 and 4, an upward direction Z and a downward or lower direction −Z are illustrated using arrows labeled "Z" and "−Z," respectively. A forward direction Y and a rearward direction −Y are illustrated using arrows labeled "Y" and "−Y," respectively. A starboard direction X and a port direction −X are illustrated using arrows labeled "X" and "−X," respectively. The directions illustrated using these arrows are applicable to the apparatus shown and discussed throughout this application. The port direction may also be referred to as the portward direction. In one or more embodiments, the upward direction is generally opposite the downward direction. In one or more embodiments, the upward direction and the downward direction are both generally orthogonal to an XY plane defined by the forward direction and the starboard direction. In one or more embodiments, the forward direction is generally opposite the rearward direction. In one or more embodiments, the forward direction and the rearward direction are both generally orthogonal to a ZY plane defined by the upward direction and the starboard direction. In one or more embodiments, the starboard direction is generally opposite the port direction. In one or more embodiments, starboard direction and the port direction are both generally orthogonal to a ZX plane defined by the upward direction and the forward direction. Various direction-indicating terms are used herein as a convenient way to discuss the objects shown in the figures. It will be appreciated that many direction indicating terms are related to the instant orientation of the object being described. It will also be appreciated that the objects described herein may assume various orientations without deviating from the spirit and scope of this detailed description. Accordingly, direction-indicating terms such as "upwardly," "downwardly," "forwardly," "backwardly," "portwardly," and "starboardly," should not be interpreted to limit the scope of the invention recited in the attached claims.

Figure 7C:
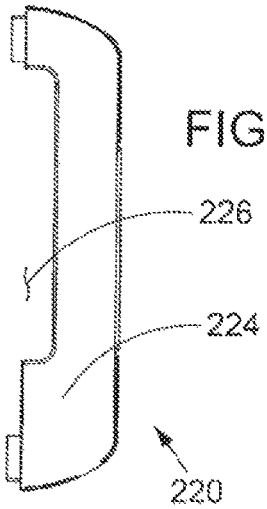
FIG. 7C is a top view of the starboard shell shown in FIG. 7A.
Figure 7A:
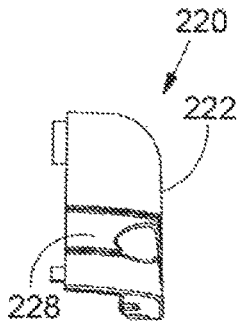
FIG. 7A is a front view of a starboard shell for a magazine loader in accordance with the detailed description.
Figure 7B:
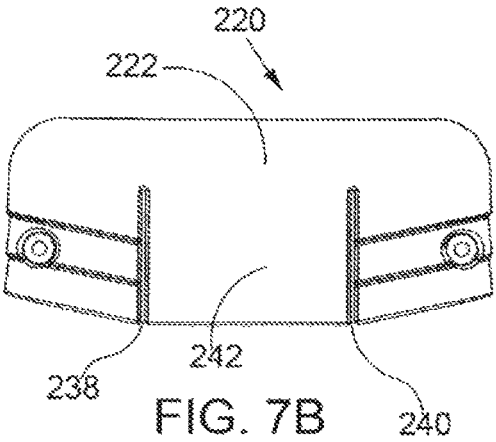
FIG. 7B is a right side view of the starboard shell shown in FIG. 7A.

FIG. 7A through FIG. 7F are elevation and plan views showing six sides of the starboard shell 220. Engineer graphics textbooks generally refer to the process used to create views showing six sides of a three dimensional object as multiview projection or orthographic projection. It is customary to refer to multiview projections using terms such as front view, right side view, top view, rear view, left side view, and bottom view. In accordance with this convention, FIG. 7A may be referred to as a front view of the starboard shell 220, FIG. 7B may be referred to as a right side view of the starboard shell 220, and FIG. 7C may be referred to as a top view of the starboard shell 220. FIG. 7A through FIG. 7F may be referred to collectively as FIG. 7. Terms such as front view and right side view are used herein as a convenient method for differentiating between the views shown in FIG. 7. It will be appreciated that the elements shown in FIG. 7 may assume various orientations without deviating from the spirit and scope of this detailed description. Accordingly, the terms front view, right side view, top view, rear view, left side view, bottom view, and the like should not be interpreted to limit the scope of the invention recited in the attached claims. FIG. 7D may be referred to as a rear view of the starboard shell 220, FIG. 7E may be referred to as a left side view of the starboard shell 220, and FIG. 7F may be referred to as a bottom view of the starboard shell 220.

Figure 8D:
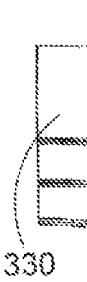
FIG. 8D is a rear view of the port shell shown in FIG. 8A.
Figure 8E:
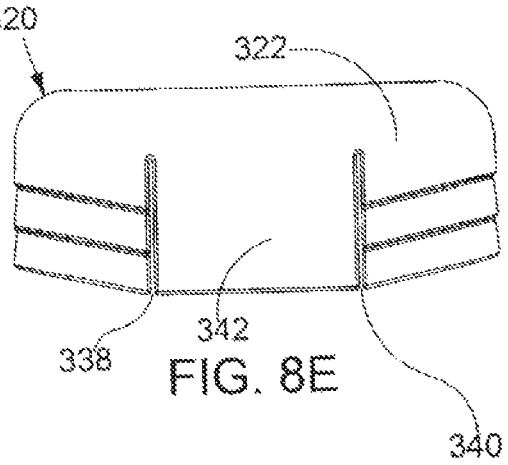
FIG. 8E is a left side view of the port shell shown in FIG. 8A.
Figure 8F:
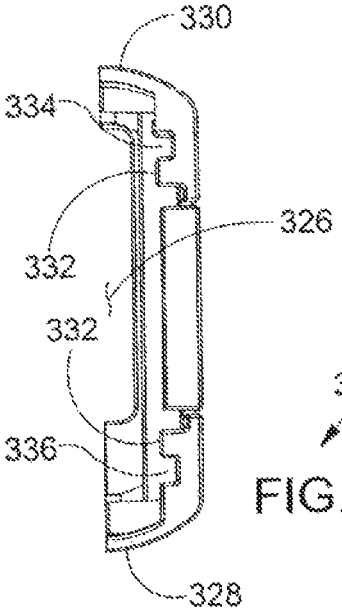
FIG. 8F is a bottom view of the port shell shown in FIG. 8A.

Referring to FIG. 8A through FIG. 8F, views showing six sides of the port shell 320. In the field of engineer graphics, the process used to create views showing six sides of a three-dimensional object may be referred to as multiview projection or orthographic projection. It is also customary to refer to multiview or orthographic projection using terms such as front view, right side view, top view, rear view, left side view, and bottom view. In accordance with this convention, FIG. 8A may be referred to as a front view of the port shell 320, FIG. 8B may be referred to as a right side view of the port shell 320, and FIG. 8C may be referred to as a top view of the port shell 320. FIG. 8A through FIG. 8F may be referred to collectively as FIG. 8. Terms such as front view and right side view are used herein as a convenient method for differentiating between the views shown in FIG. 8. It will be appreciated that the elements shown in FIG. 8 may assume various orientations without deviating from the spirit and scope of this detailed description. Accordingly, the terms front view, right side view, top view, rear view, left side view, bottom view, and the like should not be interpreted to limit the scope of the invention recited in the attached claims. FIG. 8D may be referred to as a rear view of the port shell 320, FIG. 8E may be referred to as a left side view of the port shell 320, and FIG. 8F may be referred to as a bottom view of the port shell 320.

Figure 9C:
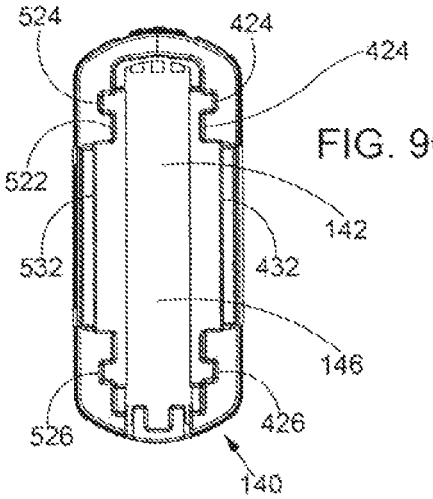
FIG. 9C is a top view of the body shown in FIG. 9A.
Figure 9A:
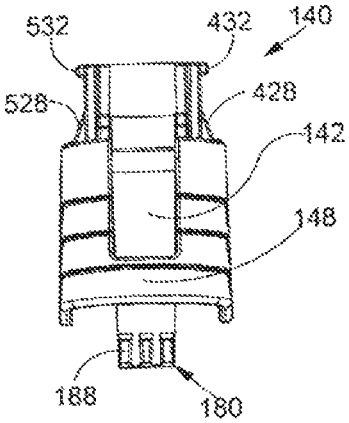
FIG. 9A is a front view of a body for a magazine loader in accordance with the detailed description.
Figure 9B:
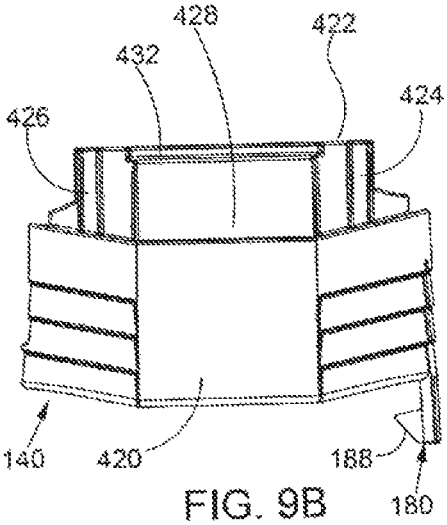
FIG. 9B is a right side view of the body shown in FIG. 9A.
Figure 9D:
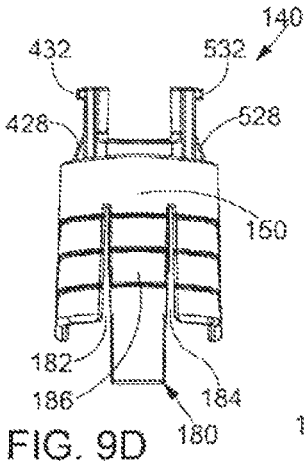
FIG. 9D is a rear view of the body shown in FIG. 9A.
Figure 9E:
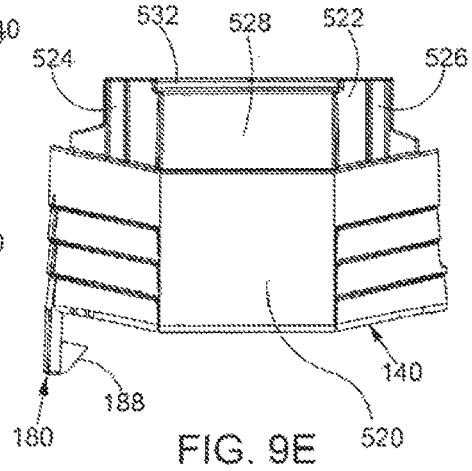
FIG. 9E is a left side view of the body shown in FIG. 9A.
Figure 9F:
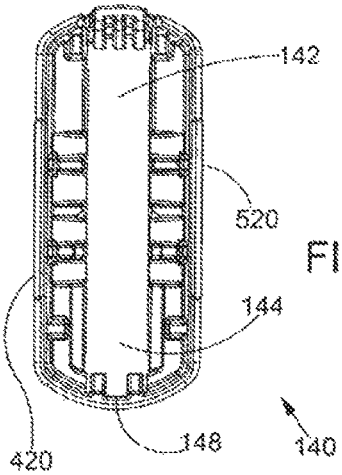
FIG. 9F is a bottom view of the body shown in FIG. 9A.

FIG. 9A through FIG. 9F are elevation and plan views showing six sides of the body 140. Engineer graphics textbooks generally refer to the process used to create views showing six sides of a three dimensional object as multiview projection or orthographic projection. It is customary to refer to multiview projections using terms such as front view, right side view, top view, rear view, left side view, and bottom view. In accordance with this convention, FIG. 9A may be referred to as a front view of the body 140, FIG. 9B may be referred to as a right side view of the body 140, and FIG. 9C may be referred to as a top view of the body 140. FIG. 9A through FIG. 9F may be referred to collectively as FIG. 9. Terms such as front view and right side view are used herein as a convenient method for differentiating between the views shown in FIG. 9. It will be appreciated that the elements shown in FIG. 9 may assume various orientations without deviating from the spirit and scope of this detailed description. Accordingly, the terms front view, right side view, top view, rear view, left side view, bottom view, and the like should not be interpreted to limit the scope of the invention recited in the attached claims. FIG. 9D may be referred to as a rear view of the body 140, FIG. 9E may be referred to as a left side view of the body 140, and FIG. 9F may be referred to as a bottom view of the body 140.

Figure 10C:
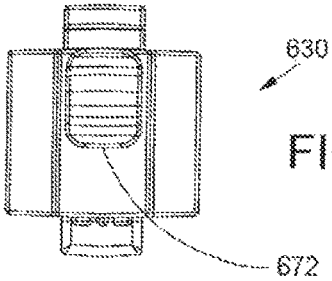
FIG. 10C is a top view of the tool shown in FIG. 10A.
Figure 10A:
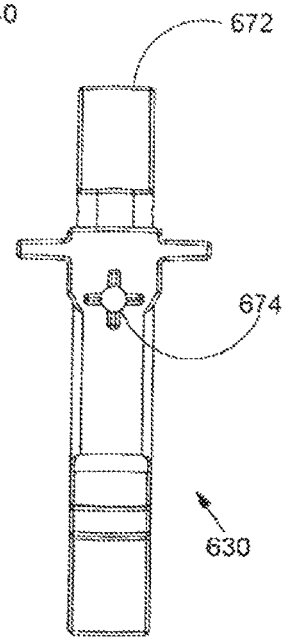
FIG. 10A is a front view of a tool for a magazine loader in accordance with the detailed description.
Figure 10B:
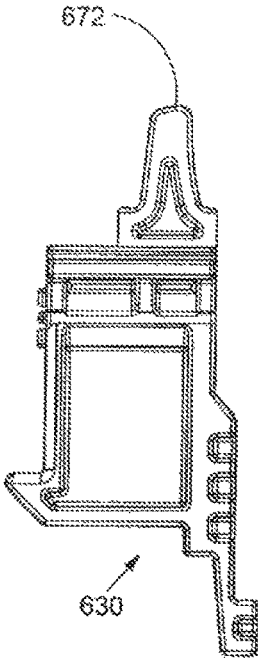
FIG. 10B is a right side view of the tool shown in FIG. 10A.
Figure 10D:
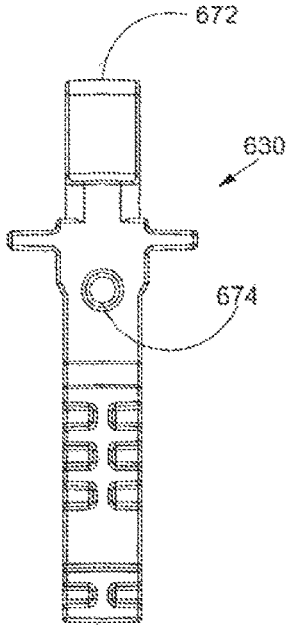
FIG. 10D is a rear view of the tool shown in FIG. 10A.
Figure 10E:
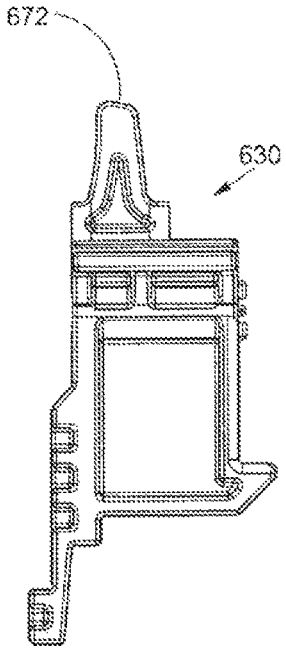
FIG. 10E is a left side view of the tool shown in FIG. 10A.
Figure 10F:
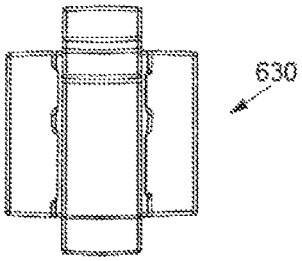
FIG. 10F is a bottom view of the tool shown in FIG. 10A.

Referring to FIG. 10A through FIG. 10F, views showing six sides of the plunger 630. In the field of engineer graphics, the process used to create views showing six sides of a three dimensional object may be referred to as multiview projection or orthographic projection. It is also customary to refer to multiview or orthographic projection using terms such as front view, right side view, top view, rear view, left side view, and bottom view. In accordance with this convention, FIG. 10A may be referred to as a front view of the plunger 630, FIG. 10B may be referred to as a right side view of the plunger 630, and FIG. 10C may be referred to as a top view of the plunger 630. FIG. 10A through FIG. 10F may be referred to collectively as FIG. 10. Terms such as front view and right side view are used herein as a convenient method for differentiating between the views shown in FIG. 10. It will be appreciated that the elements shown in FIG. 10 may assume various orientations without deviating from the spirit and scope of this detailed description. Accordingly, the terms front view, right side view, top view, rear view, left side view, bottom view, and the like should not be interpreted to limit the scope of the invention recited in the attached claims. FIG. 10D may be referred to as a rear view of the plunger 630, FIG. 10E may be referred to as a left side view of the plunger 630, and FIG. 10F may be referred to as a bottom view of the plunger 630.

Figure 11A:
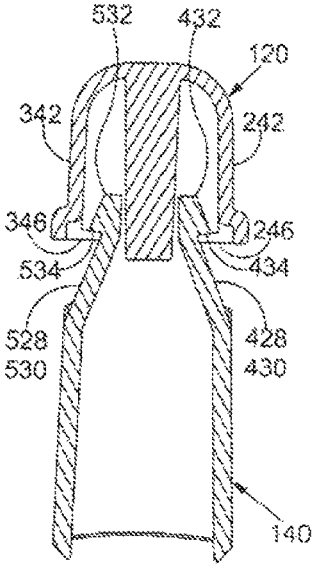
FIGS. 11A through 11C are a series of stylized diagrams showing a magazine loader including a cap and a body.
Figure 11B:
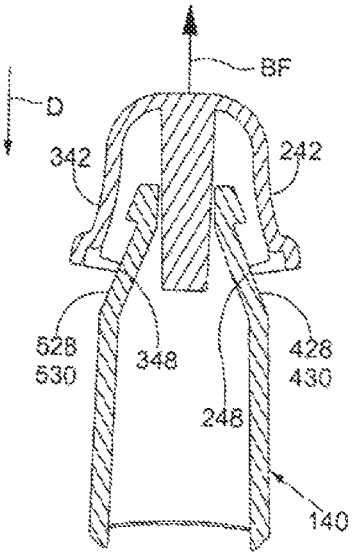
Figure 11C:
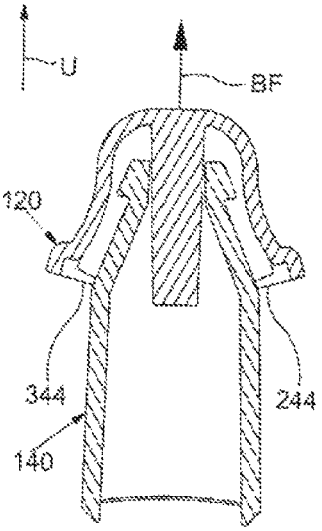

FIGS. 11A through 11C are a series of stylized diagrams showing a magazine loader 100 including a cap 120 and a body 140. FIGS. 11A through 11C may be collectively referred to as FIG. 11. The cap 120 is shown in an upper, first position relative to the body 140 in FIG. 11A. The ramp engaging surface 248 of the starboard ramp engaging portion 244 can be seen contacting the starboard ramp surface 430 of the starboard ramp 428 in FIG. 11A. In one or more embodiments, the starboard leaf spring portion 242 has an un-deflected state in which no external forces are acting on it. In the embodiment of FIG. 11A, the starboard leaf spring portion 242 may be assuming a deflected shape with the starboard leaf spring portion 242 applying a spring force to the starboard ramp surface 430 of the starboard ramp 428. A starboard stop 432 is fixed to an upper end of the starboard ramp 428. The starboard stop 432 comprises a downward facing surface 434. In the embodiment of FIG. 11A, an upward facing surface of the starboard protrusion 246 is contacting the downward facing surface 434 of the starboard stop 432.

The ramp engaging edge 348 of the port ramp engaging portion 244 can be seen contacting the port ramp surface 530 of the port ramp 528 in FIG. 11A. In one or more embodiments, the port leaf spring part 342 has an un-deflected state in which no external forces are acting on it. In the embodiment of FIG. 11A, the port leaf spring part 342 may be assuming a deflected shape with the port leaf spring part 342 applying a spring force to the port ramp surface 530 of the port ramp 528. A port stop 532 is fixed to an upper end of the port ramp 528. The port stop 532 comprises a downward facing side 536. In the embodiment of FIG. 11A, an upward facing surface of the port protrusion 346 is contacting the downward facing side 536 of the port stop 532.

In the embodiment of FIG. 11B, the cap 120 has moved in the downward direction D relative to the position of the cap 120 shown in FIG. 11A. By comparing FIG. 11A and FIG. 11B, it will be appreciated that the ramp engaging surface 248 slides along the starboard ramp surface 430 of the starboard ramp 428 as the cap 120 moves in the downward direction D. It will also be appreciated that the ramp engaging edge 348 slides along the port ramp surface 530 of the port ramp 528 as the cap 120 moves in the downward direction D when comparing FIG. 11A and FIG. 11B. The starboard leaf spring portion 242 and the port leaf spring part 342 bend in a cantilevered fashion as the cap 120 is urged downward from the position shown in FIG. 11A toward the position shown in FIG. 11B. The starboard leaf spring portion 242 and the port leaf spring part 342 produce a biasing force BF. The biasing force BF acts to urge the cap 120 in the upward direction U toward the first, upper position. The cap 120 may be urged downward, for example, by pressing downward on the cap 120 with a force greater than the biasing force BF. In the embodiment of FIG. 11C, the cap 120 has been urged further in the downward direction D relative to the position of the cap 120 shown in FIG. 11B.

Figure 12A:
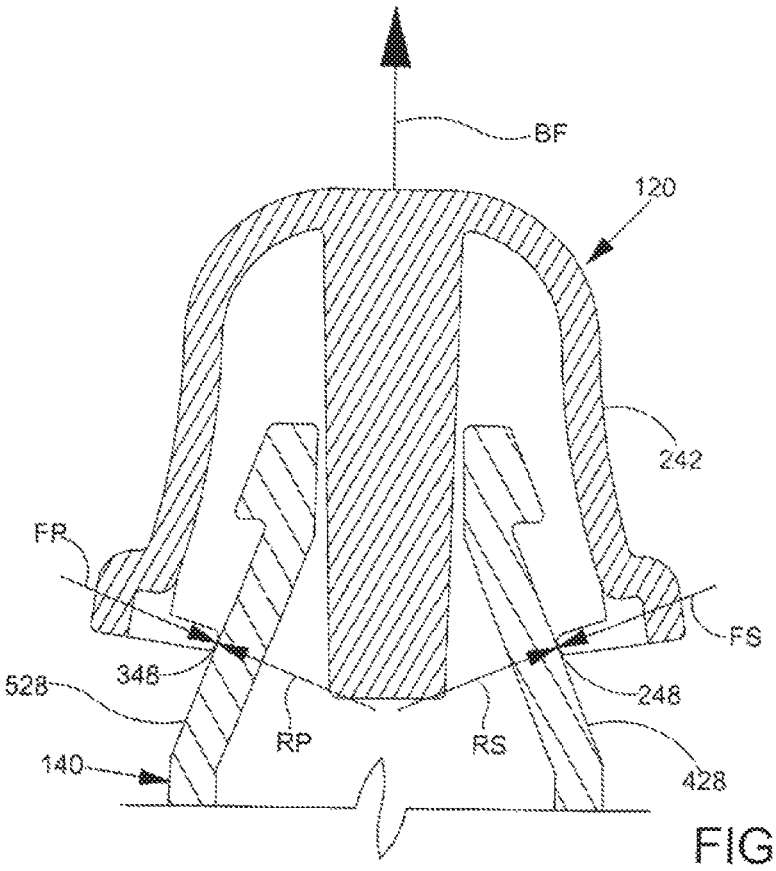
FIG. 12A is an enlarged diagram further illustrating a portion of the body and the cap shown in FIG. 11B.

FIG. 12A is an enlarged diagram further illustrating a portion of the body 140 and the cap 120 shown in FIG. 11B. The starboard leaf spring portion 242 applies a spring force FS to the starboard ramp surface 430 of the starboard ramp 428. The starboard ramp 428 provides a reaction force RS that is generally equal and opposite the spring force FS. In other words, the reaction force RS has a magnitude that is equal to the magnitude of the spring force FS and a direction that is opposite the direction of the spring force FS. The port leaf spring part 342 applies a spring force FP to the port ramp surface 530 of the port ramp 528. The port ramp 528 provides a reaction force RP that is generally equal and opposite the spring force FP. In other words, the reaction force RP has a magnitude that is equal to the magnitude of the spring force FP and a direction that is opposite the direction of the spring force FP. The starboard leaf spring portion 242 and the port leaf spring part 342 produce a biasing force BF. The biasing force BF acts to urge the cap 120 in the upward direction U toward the first, upper position.

Figure 12B:
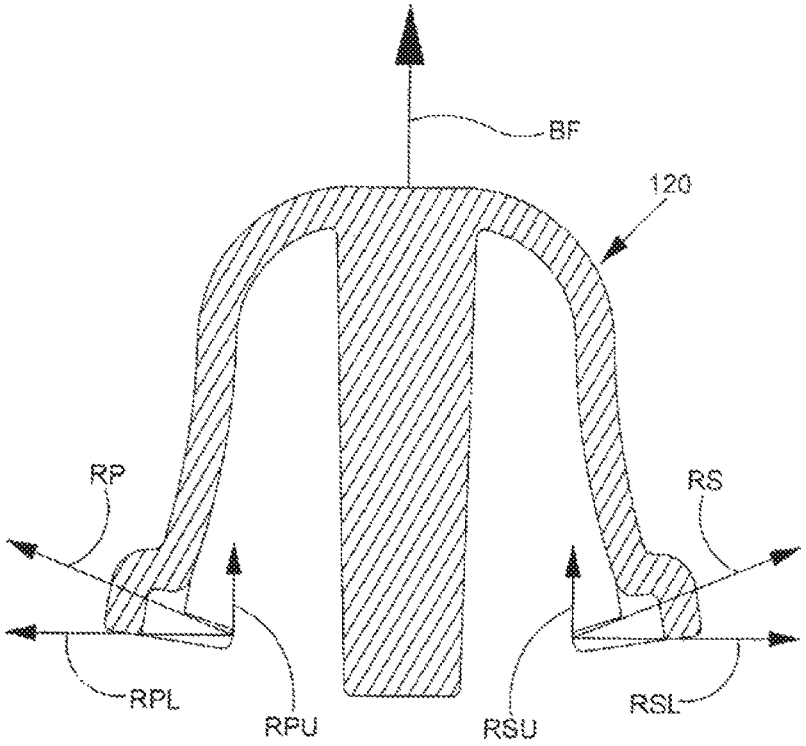
FIG. 12B is a diagram further illustrating a plurality of forces acting on the cap shown in FIG. 12A.
Figure 13:
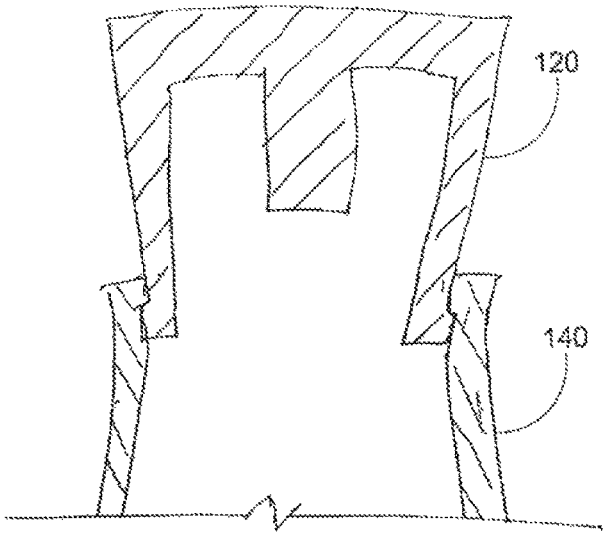
FIG. 13 is a diagram illustrating another embodiment.
Figure 14:
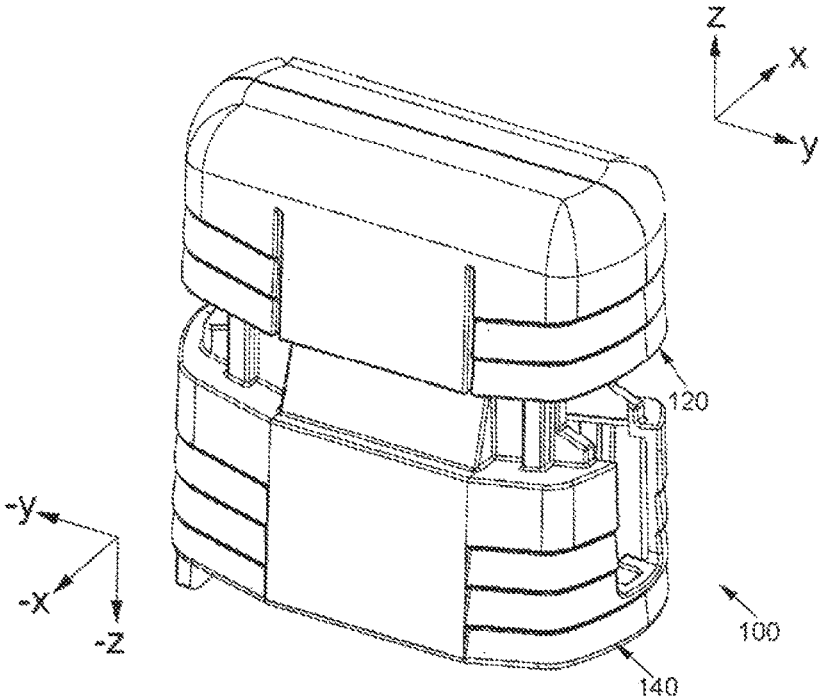
FIG. 14 is perspective views of a magazine loader in accordance with the present invention.
Figure 16:
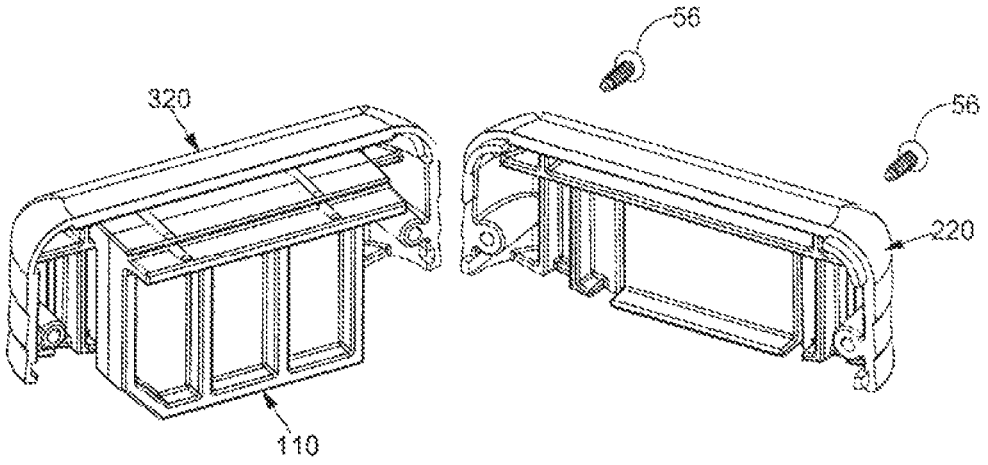
FIG. 16 is a partially exploded perspective view further illustrating selected parts of the magazine loader shown in FIG. 15.
Figure 17:
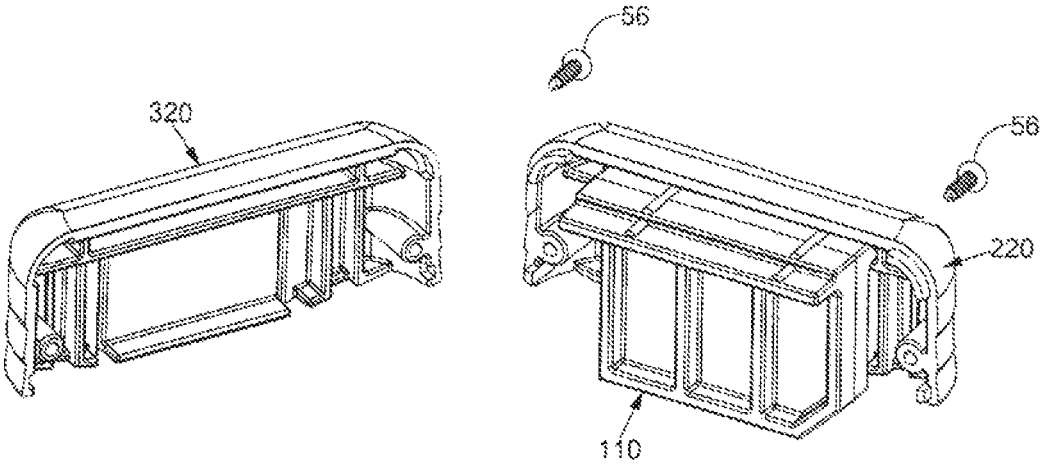
FIG. 17 is a partially exploded perspective view further illustrating selected parts of the magazine loader shown in FIG. 15.

FIG. 12B is a diagram further illustrating a plurality of forces acting on the cap 120 under circumstances such as those illustrated in FIG. 12A. A number of forces acting on the cap 120 are illustrated using arrows in FIG. 12B. In operation, the ramp engaging surface of the starboard leaf spring portion acts on the starboard ramp surface of the starboard ramp with a spring force and the starboard ramp provides a reaction force RS that is equal and opposite the spring force. The reaction force RS acting on the starboard leaf spring portion is illustrated using an arrow in FIG. 12B. The reaction force RS may be resolved in a lateral force component RSL and an upward force component RSU. The upward force component RSU contributes to the biasing force BF that acts to urge the cap 120 upward toward a first, upper position.

The ramp engaging edge of the port leaf spring portion acts on the port ramp surface of the port ramp with a spring force and the port ramp provides a reaction force RP that is equal and opposite the spring force. The reaction force RP acting on the port leaf spring portion is illustrated using an arrow in FIG. 12B. The reaction force RP may be resolved in a lateral force component RPL and an upward force component RPU. The upward force component RPU contributes to the biasing force BF that acts to urge the cap 120 upward toward a first, upper position. In one or more embodiments, the upward force component RPU and the upward force component RSU combine to produce the biasing force BF. The biasing force BF acts to urge the cap in the upward direction toward a first, upper position.

Referring, for example, to FIGS. 3 and 4, an example magazine loader 100 comprises a 20 body 140 and a cap 120 slidingly engaged with the body 140. The body 140 may have, for example, a pair of opposing forward and rearward wall portions and a pair of lateral wall portions, together defining a body interior or cavity 142 and an open bottom conformingly sized to receive the upper end of the rifle magazine. In embodiments, the body 140 also has a forward upward slot or throat 144 sized for sequentially receiving a plurality of individual cartridges into the interior or cavity 142 of the body 140 and a pair of upwardly extending slide guides or ramps with a forward backward slot or throat 144 positioned between the pair of slide guides or ramps. In embodiments, the cap 120 has four side wall portions defining a cap interior volume 124 and the cap 120 is slidingly attached to the upwardly extending slide guides or ramps within the four side wall portions. In embodiments, the cap 120 includes a downward projection or plunger 110 within the four side wall portions positioned for pushing one of the plurality of individual cartridges inserted into the forward upper slot downward into the magazine when the magazine has been inserted into the open bottom of the body. In embodiments, the cap 120 is movable on the body 140 downwardly for the cartridge loading. In embodiments, such a magazine loader 100 has the cap 120 that is biased upwardly with respect to the body 140 whereby when the cap 120 is not being pushed downwardly with respect to the body 140, the cap 120 is urged to a normal upward position. In embodiments of the magazine loader 100 above the cap 120 is biased upwardly by a pair of upwardly extending slide guides or ramps each having a taper upwardly and the cap 120 has resilient slide guide engaging portions that are deflected outwardly by the slide guides or ramps as the cap 120 is pushed downwardly with respect to the body 140.

In embodiments, an example magazine loader comprises a body 140 and a cap 120 slidingly engaged with the body 140. The body 140 may have a pair of opposing forward and rearward wall portions and a pair of lateral wall portions, together defining a body interior or cavity 142 and an open bottom conformingly sized to receive the upper end of the rifle magazine. The body may also include a forward upward slot or throat 144 sized for receiving individual cartridges into the interior of the body 140, and a pair of upwardly extending slide guides or ramps with the slot or throat positioned between the pair of slide guides or ramps. In embodiments, each of the slide glides or ramps have an outwardly facing surface that is tapered in an upwardly direction. In embodiments, the cap 120 has four side wall portions defining a cap interior volume 124 and the cap 120 is slidingly attached to the upwardly extending slide guides or ramps within the four side wall portions. In embodiments, the cap 120 includes a downward projection or plunger 110 within the four side wall portions positioned for pushing a cartridge inserted into the forward upper slot downward into the magazine when the magazine is inserted into the open bottom of the body. In embodiments, the cap is biased to an upward position by a pair of leaf springs engaged with the pair of slide guides or ramps. In embodiments, in the magazine loader 100 described above, the leaf springs have a substantially undeflected position when the cap is in an upward position and the pair of leaf springs are each increasingly deflected outwardly as the cap 120 is pushed downwardly with respect to the body 140 whereby the deflected leaf springs urge the cap 120 toward the upward position. In embodiments, such a magazine loader as described above, further comprises a cartridge ejection member within the cap, the cartridge ejection member having an exposed lever, the cartridge ejection member movable forwardly to force a cartridge in an uppermost position in the magazine out of the magazine and out of the forward upper slot of the body. In embodiments, the cartridge ejection member is slidingly engaged with the cap.

In embodiments, a magazine loader 100 comprises a body 140 for receiving a magazine and a cap 120 slidingly engaged with the body 140 for loading cartridges into the magazine received by the body 140. The body 140 may have a pair of opposing forward and rearward wall portions and a pair of lateral wall portions, together defining a body interior or cavity 142 and an open bottom conformingly sized to receive the upper end of the rifle magazine. The body 140 may also have an upward slot or throat 144 sized for receiving individual cartridges into the interior or cavity 142 of the body 140. In embodiments, the cap 120 is movably attached to the body 140. In embodiments, the cap 120 has a downwardly extending plunger 110 that is received in the upward slot or throat 144 and that is configured for pushing a cartridge into the open interior of the magazine received by the body 140. In embodiments, one of the cap 120 and body 140 has a slide guide or ramp tapered in a direction away from said one with respect to a vertical axis of said one and the other of the cap 120 and body 140 has a spring member for engaging the slide guide or ramp of said one, whereby the cap 120 and body 140 are urged away from each other by the spring member. In embodiments, such as above, one of the cap 120 and body 140 has two slide guides or ramps and the other of the cap 120 and body 140 has two spring members. In embodiments, the spring members are a leaf springs. In embodiments, the leaf springs are each defined by two upright slits in a respective lateral wall portion of said one.

The following United States patents are hereby incorporated by reference herein: U.S. Pat. Nos. 4,464,855, 4,689,909, 4,719,715, 4,827,651, 4,829,693, 4,888,902, 4,993,180, 5,249,386, 5,355,606, 5,377,436, 6,810,616, 6,178,683, 6,817,134, 7,059,077, 7,257,919, 7,383,657, 7,487,613, 7,503,138, 7,637,048, 7,805,874, 9,212,859, 9,239,198, 9,347,722 and 9,273,917.

The above references in all sections of this application are herein incorporated by references in their entirety for all purposes. Components illustrated in such patents may be utilized with embodiments herein. Incorporation by reference is discussed, for example, in MPEP section 2163.07(B).

All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any incorporated by reference references, any accompanying claims, abstract and drawings), or to any novel one, or any novel combination, of the steps of any method or process so disclosed. The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention. The inventors of the magazine loaders described herein are associated with Fred Sparks Design of St. Louis, Mo.

What is claimed is:

1. A magazine loader for loading cartridges in a rifle magazine, the magazine loader comprising:

a body having a pair of opposing forward and rearward wall portions and a pair of lateral wall portions, together defining a body interior and an open bottom sized to receive an upper end of the rifle magazine, a slot sized for receiving individual cartridges into the body interior;

a cap having four side wall portions defining a cap interior, the cap configured to be slidably attached to the body, the cap having a projection within the four side wall portions positioned for pushing a cartridge inserted into body interior into the rifle magazine when the rifle magazine is inserted into the open bottom of the body, wherein one of the cap and body has two slide guides and the other of the cap and body has two spring members to bias the cap to an upward position with respect to the body; and a latch to hold the rifle magazine in position relative to the body of the magazine loader.

2. The magazine loader of claim 1, wherein the slide guides are disposed on the body and the two spring members are disposed on the cap.

3. The magazine loader of claim 1, wherein the spring members are leaf springs.

4. The magazine loader of claim 1, wherein the slide guides comprise a starboard ramp and a port ramp supported by the lateral wall portions; and the spring members comprise a starboard leaf spring portion and a port leaf spring portion disposed on the opposing wall portions, the starboard leaf spring contacting the starboard ramp and the port leaf portion contacting the port ramp.

5. The apparatus of claim 1, wherein the body further comprises:

a starboard flange and a port flange extending beyond the lateral wall portions; and a throat defined between the starboard flange and the port flange, the throat being dimensioned and configured to allow sequential passage of a plurality of individual cartridges into the body cavity.

6. The apparatus of claim 5 wherein the body further comprises a first starboard rail, the first starboard rail extending in a direction along a first starboard rail axis, the first starboard rail projecting in a starboard direction beyond a starboard facing surface of the starboard flange, the first starboard rail extending into a first starboard channel defined by the starboard cap wall.

7. The apparatus of claim 6 wherein the body further comprises a second starboard rail, the second starboard rail extending in a direction along a second starboard rail axis, the second starboard rail projecting in the starboard direction beyond a starboard facing surface of the starboard flange, the second starboard rail extending into the second starboard channel defined by the starboard cap wall.

8. The apparatus of claim 7 wherein the body further comprises a first port rail, the first port rail extending in at direction along a first port rail axis, the first port rail projecting in a port direction beyond a port facing surface of the port flange, the first port rail extending into the first port channel defined by the port cap wall.

9. The apparatus of claim 8 wherein the body comprises a second port rail, the second port rail extending in a direction along a second port rail axis, the second port rail projecting in the port direction beyond a port facing surface of the port flange, the second port rail extending into the second port channel defined by the port cap wall.

10. A magazine loader for loading cartridges in a rifle magazine, the magazine loader comprising:

a body having a pair of opposing forward and rearward wall portions and a pair of lateral wall portions, together defining a body interior and an open bottom sized to receive an upper end of the rifle magazine, a slot sized for receiving individual cartridges into the body interior;

a cap having four side wall portions defining a cap interior, the cap configured to be slidably attached to the body, the cap having a projection within the four side wall portions positioned for pushing a cartridge inserted into body interior into the rifle magazine when the rifle magazine is inserted into the open bottom of the body, wherein one of the cap and body has a slide guide and the other of the cap and body has a leaf spring member to bias the cap to an upward position with respect to the body; and a latch to hold the rifle magazine in position relative to the body of the magazine loader.

11. The magazine loader of claim 10, wherein the slide guide is disposed on the body and the leaf spring member is disposed on the cap.

12. The magazine loader of claim 11, wherein the slide guide comprises a starboard ramp and a port ramp supported by the lateral wall portions; and the leaf spring comprises a starboard leaf spring portion and a port leaf spring portion disposed on the opposing wall portions, the starboard leaf spring contacting the starboard ramp and the port leaf portion contacting the port ramp.

13. The apparatus of claim 10, wherein the body further comprises:

a starboard flange and a port flange extending beyond the lateral wall portions; and a throat defined between the starboard flange and the port flange, the throat being dimensioned and configured to allow sequential passage of a plurality of individual cartridges into the body cavity.

14. The apparatus of claim 13 wherein the body further comprises a first starboard rail, the first starboard rail extending in a direction along a first starboard rail axis, the first starboard rail projecting in a starboard direction beyond a starboard facing surface of the starboard flange, the first starboard rail extending into a first starboard channel defined by the starboard cap wall.

15. The apparatus of claim 14 wherein the body further comprises a second starboard rail, the second starboard rail extending in a direction along a second starboard rail axis, the second starboard rail projecting in the starboard direction beyond a starboard facing surface of the starboard flange, the second starboard rail extending into the second starboard channel defined by the starboard cap wall.

16. The apparatus of claim 15 wherein the body further comprises a first port rail, the first port rail extending in at direction along a first port rail axis, the first port rail projecting in a port direction beyond a port facing surface of the port flange, the first port rail extending into the first port channel defined by the port cap wall.

17. The apparatus of claim 16 wherein the body comprises a second port rail, the second port rail extending in a direction along a second port rail axis, the second port rail projecting in the port direction beyond a port facing surface of the port flange, the second port rail extending into the second port channel defined by the port cap wall.

* * * * *